US012650116B2

(12) United States Patent
Mueller et al.

(10) Patent No.: US 12,650,116 B2
(45) Date of Patent: Jun. 9, 2026

(54) RADIAL PISTON PUMP WITH HOUSING AND COVER ARRANGEMENT

(71) Applicants: thyssenkrupp Dynamic Components GmbH, Ilsenburg (DE); thyssenkrupp AG, Essen (DE)

(72) Inventors: Ulf Mueller, Chemnitz (DE); Tim Mueller, Chemnitz (DE); Tony Stein, Frohburg (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 15 days.

(21) Appl. No.: 18/289,366

(22) PCT Filed: Apr. 29, 2022

(86) PCT No.: PCT/EP2022/061486
§ 371 (c)(1),
(2) Date: Nov. 2, 2023

(87) PCT Pub. No.: WO2022/238149
PCT Pub. Date: Nov. 17, 2022

(65) Prior Publication Data

US 2024/0240627 A1 Jul. 18, 2024

(30) Foreign Application Priority Data

May 10, 2021 (DE) ..... 10 2021 204 716.5

(51) Int. Cl.
*F04B 1/0421* (2020.01)
*F04B 27/04* (2006.01)
*F04B 53/16* (2006.01)

(52) U.S. Cl.
CPC ..... *F04B 1/0421* (2013.01); *F04B 27/04* (2013.01); *F04B 53/16* (2013.01)

(58) Field of Classification Search
CPC ..... F04B 27/04; F04B 53/16; F04B 1/0421
See application file for complete search history.

(56) References Cited

U.S. PATENT DOCUMENTS 3,784,331 A 1/1974 Heidorn
4,311,437 A 1/1982 Liska
(Continued)

FOREIGN PATENT DOCUMENTS

CN 102439312 A 5/2012
CN 103321878 A * 9/2013
(Continued)

OTHER PUBLICATIONS

English Translation of International Search Report issued in PCT/EP2022/061486, dated Jul. 30, 2022.

*Primary Examiner* — Nathan C Zollinger
(74) *Attorney, Agent, or Firm* — thyssenkrupp North America, LLC

(57) ABSTRACT

A radial piston pump, in particular radial piston compressor, including a drive shaft with an eccentric, and at least one piston/working chamber combination, wherein the piston/working chamber combination includes a working chamber and a piston, wherein the radial piston pump includes at least two piston/working chamber combinations extending radially from the drive shaft, wherein each working chamber is closed with a cover, wherein the radial piston pump is equipped with a housing component with an integrated retaining ring for fixing all of the covers of the radial piston pump.

19 Claims, 5 Drawing Sheets

(56) References Cited

U.S. PATENT DOCUMENTS

| | | | | |
|---|---|---|---|---|
| 6,322,328 | B1 * | 11/2001 | Techet | F04B 1/0421 417/570 |
| 7,959,415 | B2 * | 6/2011 | Schuetzle | F04B 35/06 417/564 |
| 8,926,298 | B2 * | 1/2015 | Rajput | F04B 49/22 417/532 |
| 2012/0111185 | A1 * | 5/2012 | Stephenson | F04B 1/0421 91/491 |
| 2013/0064691 | A1 | 3/2013 | Pecorari | |
| 2014/0030128 | A1 | 1/2014 | Gaertner et al. | |
| 2020/0224646 | A1 | 7/2020 | Flo et al. | |
| 2020/0271109 | A1 | 8/2020 | Nakajima et al. | |
| 2024/0240633 | A1 * | 7/2024 | Mueller | F04B 53/1037 |

FOREIGN PATENT DOCUMENTS

| | | | | |
|---|---|---|---|---|
| DE | 2852852 | B1 | 6/1980 | |
| DE | 4034267 | A1 * | 5/1991 | F04B 53/1075 |
| DE | 2947860 | C3 * | 10/1994 | F04B 1/053 |
| DE | 19517628 | A1 * | 11/1996 | F04B 1/0452 |
| DE | 10 2010 064 084 | A1 | 6/2012 | |
| EP | 0520286 | A2 | 12/1992 | |
| EP | 0522116 | A1 | 1/1993 | |
| EP | 2550432 | B1 | 1/2013 | |
| GB | 2065240 | A * | 6/1981 | F04B 27/053 |
| WO | WO-9214056 | A1 * | 8/1992 | F04B 1/053 |

* cited by examiner

Fig.1
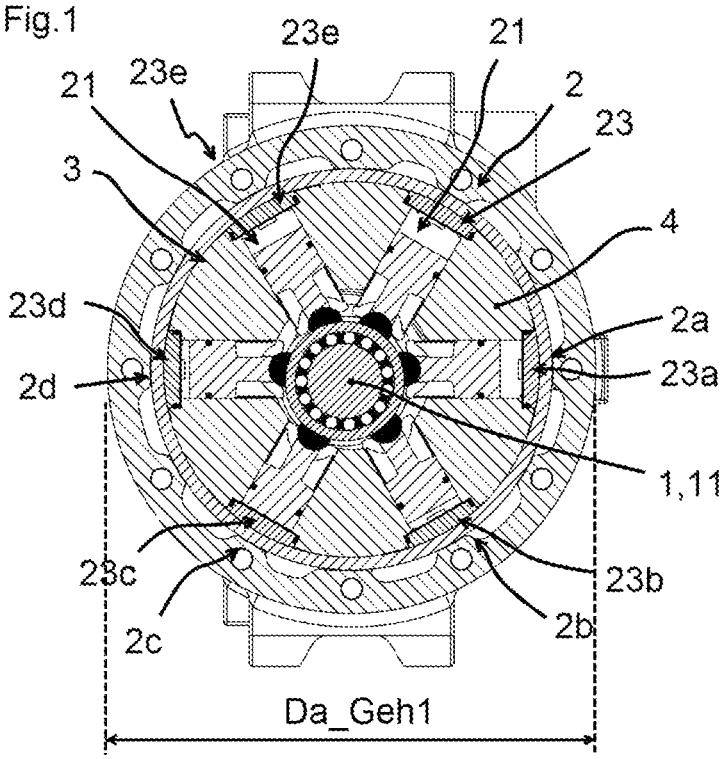
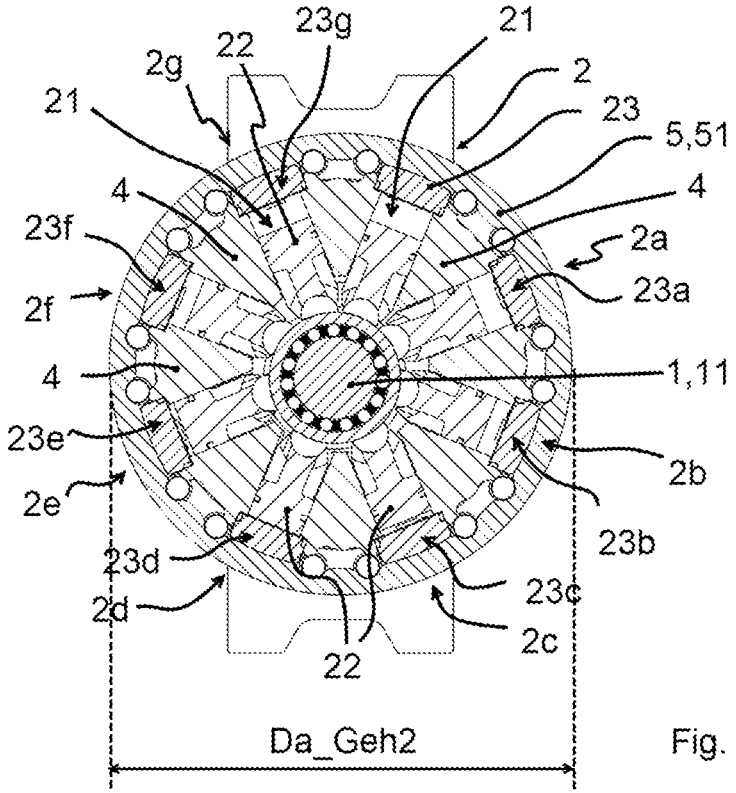
Fig. 2

Fig. 3
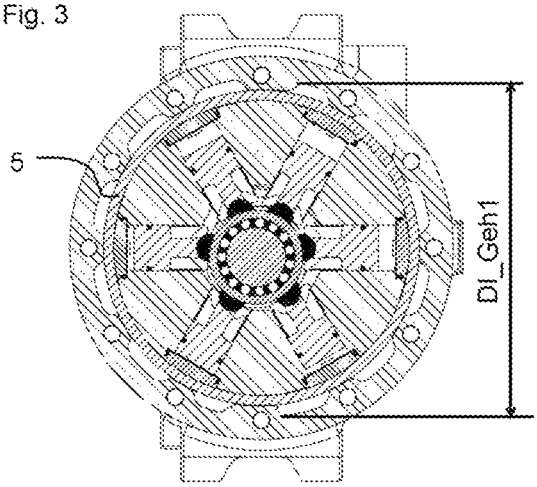
Fig. 4
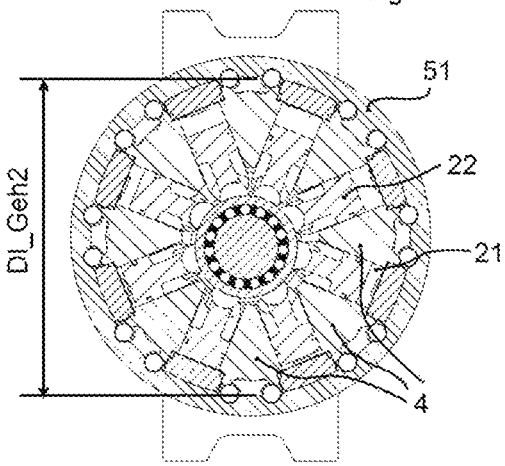
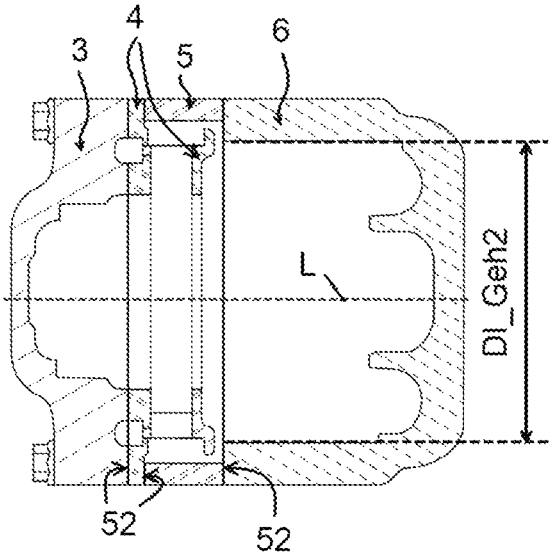
Fig. 5
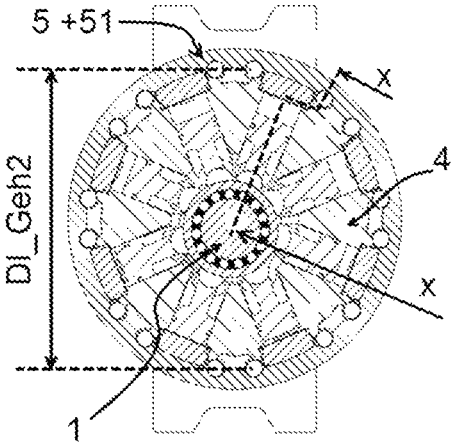
Fig. 6

RADIAL PISTON PUMP WITH HOUSING AND COVER ARRANGEMENT

CROSS REFERENCE TO RELATED APPLICATIONS

This application is a U.S. National Stage Entry of International Patent Application Serial Number PCT/EP2022/061486, filed Apr. 29, 2022, which claims priority to German Patent Application No. DE 10 2021 204 716.5, filed May 10, 2021, the entire contents of which are incorporated herein by reference.

FIELD

The present disclosure generally relates to a radial piston pump, in particular a radial piston compressor.

BACKGROUND

A radial piston pump is an element of fluid technology. In the case of this pump, which can also be regarded as a pump according to the radial piston principle, the piston/working chamber combinations are arranged radially and perpendicular to the drive shaft, in contrast to an axial piston compressor. The delivery or stroke movement of each individual working piston is brought about by an eccentric located on the drive shaft. As a rule, the radial piston pump comprises a plurality of piston/working chamber combinations which extend in a star shape and radially from the drive shaft. The radial piston pump pumps a fluid from a low-pressure chamber into a high-pressure chamber.

Radial piston pumps are used, for example, as compressors for coolant in air conditioning systems of motor vehicles, especially also in electrically driven motor vehicles. A radial piston pump can also be regarded as a radial piston compressor or refrigerant compressor according to the radial piston principle.

In this connection, it is provided that a cover is arranged on the head side of the working chamber or closes same. The cover is accordingly exposed to the pressures prevailing in the working chamber and has to be fixed accordingly.

According to the prior art, the cover is screwed down, for example. It is clear that the outlay on installation is not insignificant if accordingly all of the covers of a radial piston pump with a plurality of piston/working chamber combinations have to be fitted.

In a patent application filed by the applicant, it is proposed to use a common retaining ring to fix all of the covers of the radial piston pump. In order to ensure a distance of the housing component in the radial direction from the retaining ring, the internal diameter of the housing component has to be larger by the distance than the external diameter of the retaining ring. This means that the radial installation space of the entire component is relatively large.

Although an assembly-friendly solution is already proposed here, there is still a need for improvement, especially with regard to the necessary space requirement.

Thus a need exists for an improved radial piston pump, in particular a radial piston pump, which is easy to assemble, but also tends to require less space.

According to the invention, this object is achieved by a radial piston pump having the characterizing features of claim 1. Owing to the fact that the radial piston pump is equipped with a housing component with an integrated retaining ring for fixing all of the covers of the radial piston pump, a highly space-saving radial piston pump can be provided. In other words, the function of the retaining ring for fixing the covers is in particular integrated in a separate housing component. The benefit is that only one component takes over the retaining force of the covers and at the same time is part of the housing of the radial piston pump, thus resulting in particular in a reduction in the number of components and/or a simplification of the components. The advantage of this integration is in particular that there is no need to screw down the cover, as a result of which, in particular, working steps can be saved and components for fixing purposes, e.g. screws, securing rings, etc., can be omitted. Furthermore, a reduction in the size of the radial installation space of the entire assembly can be achieved. In particular, the housing screw connection can be placed further inward, i.e. on a smaller hole circle, and thus the external diameter of the entire assembly can be reduced radially. The radial installation space can be reduced with a retaining ring. This results in a smaller pressurized diameter, thereby resulting in a smaller area and thus, in turn, in a lower required axial force. This allows a smaller screw size. Reducing the pressurized internal diameter leads to a reduction in the pressure surface and this then results in a lower axial force. A lower axial force that pushes the housing parts apart means a lower operating force for the housing screw connection. One less of housing screw connection also results from the fact that a smaller diameter means a lower axial force compared to a retaining ring. Advantageously, there is also a lower load on the axial screw connection of the housings, thus associated possibly with a cost reduction by using fewer screws or screws with a lower strength or screws with a smaller diameter. In addition, the pressurized area within the axial sealing faces, especially in the axial direction of the overall component, is smaller. An advantageous secondary effect is the reduction in the overall screw force; in particular, because of the reduction in the radial installation space, the pressurized area within the housing sealing faces is reduced. A reduced area means a correspondingly reduced force at the same pressure.

BRIEF DESCRIPTION OF THE FIGURES

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 shows a radial piston pump with a separate retaining ring in a sectional view.

FIG. 2 shows a radial piston pump according to the disclosure in a sectional view.

FIG. 3 shows a radial piston pump with a separate retaining ring in a view from the front.

FIG. 4 shows a radial piston pump according to the disclosure in a view from the front.

FIG. 5 shows a radial piston pump according to the disclosure in a longitudinal sectional view.

FIG. 6 shows a radial piston pump according to the disclosure in a cross-sectional view.

DETAILED DESCRIPTION

Figure 7:
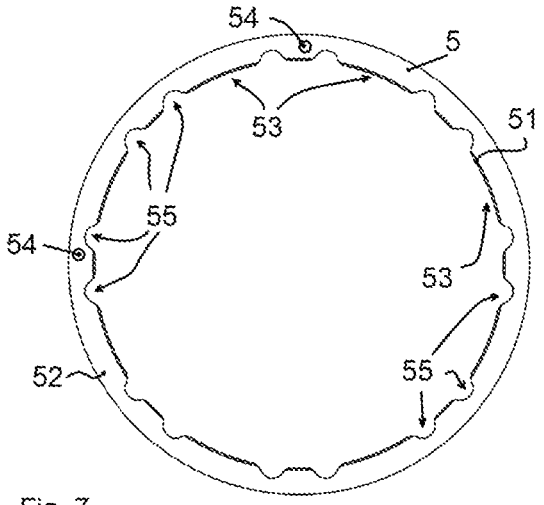
FIG. 7 shows a housing component of a radial piston pump according to the disclosure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Another disclosed advantage is that it can be provided that the radial piston pump comprises at least three, preferably eight, piston/working chamber combinations which are arranged in a star shape around the drive shaft. Accordingly, a multiplicity of piston/working chamber combinations can be combined in a compact radial piston pump.

Another disclosed advantage is that it can be provided that the radial piston pump has at least one further housing component, in particular a high-pressure housing, a cylinder housing, in particular for receiving the piston/working chamber combinations, and/or a stator housing, in particular for receiving a rotor of an electric motor, wherein the housing component with an integrated retaining ring and the further housing component or components form the housing of the radial piston pump. In principle, it is provided that the housing component with an integrated retaining ring and the further housing components form the housing of the radial piston pump. Accordingly, the housing components complement one another to form an overall housing and a correspondingly compact radial piston pump.

Another disclosed advantage is that the housing component with an integrated retaining ring has plane-parallel axial sealing faces. By means of sealing faces configured in such a way, a tight connection to the adjacent housing component, such as to the cylinder housing, can be provided.

Another disclosed advantage is that the surfaces of the sealing faces of the housing component with an integrated retaining ring are provided with concentric grooves, in particular with a ripple in the radial direction. The sealing effect can be further improved by the concentric groove or grooves.

Another disclosed advantage is that contact faces are provided on the housing component with an integrated retaining ring and on the cover, wherein the contact faces are preferably designed such that the housing component with an integrated retaining ring can fix the cover on the cylinder housing.

Another disclosed advantage is that the contact face with respect to and/or of the respective cover is flat or concave/convex, wherein the curvature of the cover or of the housing component with an integrated retaining ring can preferably run axially with respect to the shaft of the compressor and/or transversely with respect thereto. By such a configuration of the contact faces, an improved mounting of the cover by the housing component with an integrated retaining ring can be ensured.

Another disclosed advantage is that the cover and/or the housing component with an integrated retaining ring has an overlap in the joint diameter, in particular in the region of the cover on the cylinder housing, such that an interference fit is produced between the cover and the housing-integrated retaining ring. The overlap, also to be referred to as an oversize, can be used for producing or maintaining a press fit by utilizing a certain amount of elasticity from the housing component with an integrated retaining ring. The joint diameter refers to the "common" diameter between the cover and the retaining ring, which, by means of the configuration as an oversize fit, ensures the function of the cover fixing.

Another disclosed advantage is that one screw is provided for the connection of all of the housing parts. This makes it easy and fast, since all of the housing components can be screwed together or to one another simultaneously.

Another disclosed advantage is that the housing component with an integrated retaining ring consists of steel or a steel alloy at least in sections. With such a material selection, the high strength requirements of its function as a retaining ring (surface pressure with respect to the cover) can be achieved in an advantageous manner.

Another disclosed advantage is that surface contact is provided between the cover and the housing component with an integrated retaining ring. An optimum transmission of force and correspondingly little or low punctiform loading can be achieved by surface contact.

Another disclosed advantage is that the housing component with an integrated retaining ring and the cover at least partially have mutually corresponding shapes. This allows an optimal form fit to be achieved between the housing component with an integrated retaining ring and the cover or the covers. An optimized area means, for example, better distribution of the forces and/or less deformation of the cover.

Another disclosed advantage is that the housing component with an integrated retaining ring has at least one passage for the housing screw connection, wherein the passage for the housing screw connection is interrupted inwardly or is designed as a fully enclosed passage. While the variant with the interrupted passage is distinguished by less installation space being required, a fully enclosed passage constitutes a good seal against the internal pressure.

Another disclosed advantage is that at least one, preferably two positioning means, in particular a positioning bore, is/are provided in the housing component with an integrated retaining ring. This makes it possible to ensure that the housing component with an integrated retaining ring is always mounted in a predetermined position. In addition, assembly is facilitated in that the angular position does not have to be determined for each assembly operation.

The radial piston pump proposed here, in particular radial piston compressor, can preferably be used as an air conditioning compressor, preferably with an electric motor as a drive. The fluid is accordingly preferably a refrigerant.

The following reference signs are used in the figures:

L longitudinal axis

F fluid

D region

Da_Geh1 external diameter of a radial piston pump with a separate retaining ring
Da_Geh2 external diameter of the radial piston pump according to the invention
Di_Geh1 internal diameter of a radial piston pump with a separate retaining ring
Di_Geh2 internal diameter of the radial piston pump according to the invention
1 drive shaft
2 (*a*-*g*) piston/working chamber combination
3 high pressure housing
4 cylinder housing
5 housing component with an integrated retaining ring
6 stator housing
11 eccentric
21 working chamber
22 piston
23 (*a*-*g*) cover
24 inlet valve
25 outlet valve
26 seal
27 screw
51 retaining ring
52 sealing face
53 contact face (on the housing component)
54 positioning means, in particular positioning bore
55 passage (for the housing screw connection)
231 contact face (on the cover)
241 fluid inlet
251 fluid outlet
252 high-pressure fluid channel
521 groove Here, it goes without saying that features and details which are described in conjunction with a method also apply in conjunction with the apparatus according to the invention, and vice versa, with the result that reference is always made or can always be made mutually to the individual aspects of the invention with regard to the disclosure. Moreover, a possibly described method according to the invention can be carried out by way of the apparatus according to the invention.

The terminology used herein serves only for the purpose of description of particular embodiments, and is not intended to restrict the disclosure. As used herein, the singular forms "a/an" and "the" are also intended to include the plural forms unless the context clearly indicates otherwise. In addition, it will become clear that the terms "has" and/or "having", when used in this description, specify the presence of the stated features, integers, steps, operations, elements and/or components, but do not rule out the presence or the addition of one or more other features, integers, steps, operations, elements, components and/or groups thereof. As used herein, the term "and/or" includes any desired element and all combinations of one or more of the associated, listed elements.

First, reference is made to FIGS. 2 and 4.

A radial piston pump substantially comprises a drive shaft 1 with an eccentric 11, and at least one piston/working chamber combination 2, which is incorporated in a cylinder housing 4. To define the axial direction, a longitudinal axis L of the drive shaft 1 is shown in FIG. 5. The piston/working chamber combination 2 substantially comprises a working chamber 21 and a piston 22. The working chamber 21 is closed on the head side or piston head side by a cover 23.

As a rule, the radial piston pump comprises at least two piston/working chamber combinations 2, 2*a*, 2*b*, . . . which extend radially from the drive shaft 1. Preferably, the radial piston pump comprises at least three, preferably six, piston/working chamber combinations 2, 2*a*, 2*b*, . . . which extend correspondingly in a star shape from the drive shaft 1. Accordingly, each piston/working chamber combination 2, 2*a*, 2*b*, . . . is provided with a cover 23, 23*a*, . . . . The piston/working chamber combinations 2, 2*a*, 2*b*, . . . are preferably all incorporated in the cylinder housing 4.

Figure 10:
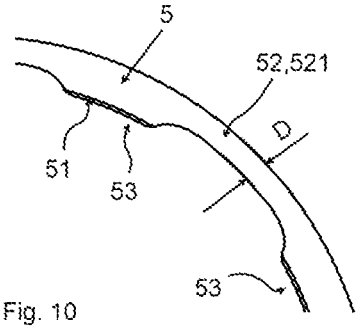
FIG. 10 shows an enlarged view of a region of a housing component according to FIG. 8.

Furthermore, a fluid inlet 241 is provided in the cover 23 or on the head side of the working chamber 21. Also, a fluid outlet 251 is provided in the working chamber 21, preferably in the wall of the working chamber 21. The fluid inlet 241 is equipped with an inlet valve 24, which can optionally close or release the fluid inlet 241. The fluid outlet 251 is equipped with an outlet valve 25, which can optionally close or release the fluid outlet 251. Alternatively, it can also be provided that the fluid inlet 241 or the inlet valve 24 is provided in the piston 22, in particular in the piston head. Here, for example, reference can be made to FIG. 10.

Figure 11:
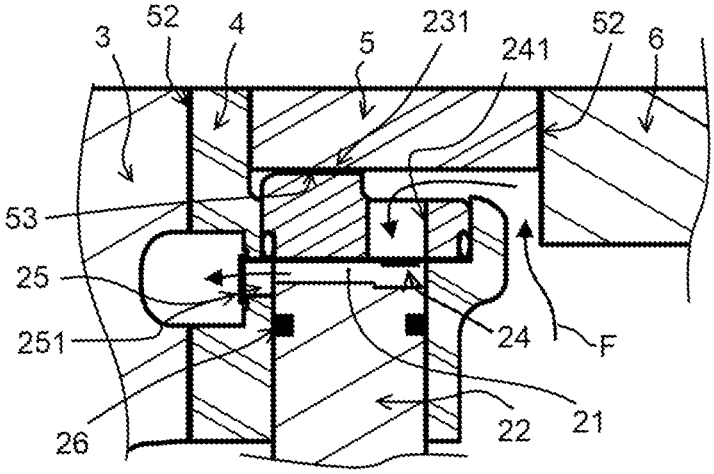
FIG. 11 shows a schematic of the fluid flow of a radial piston pump according to the disclosure.
Figure 12:
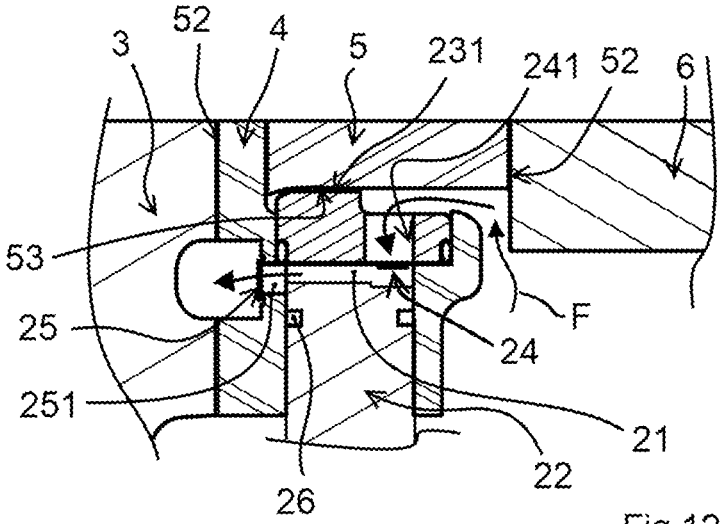
FIG. 12 shows a schematic of the fluid flow of a radial piston pump according to the disclosure.
Figure 13:
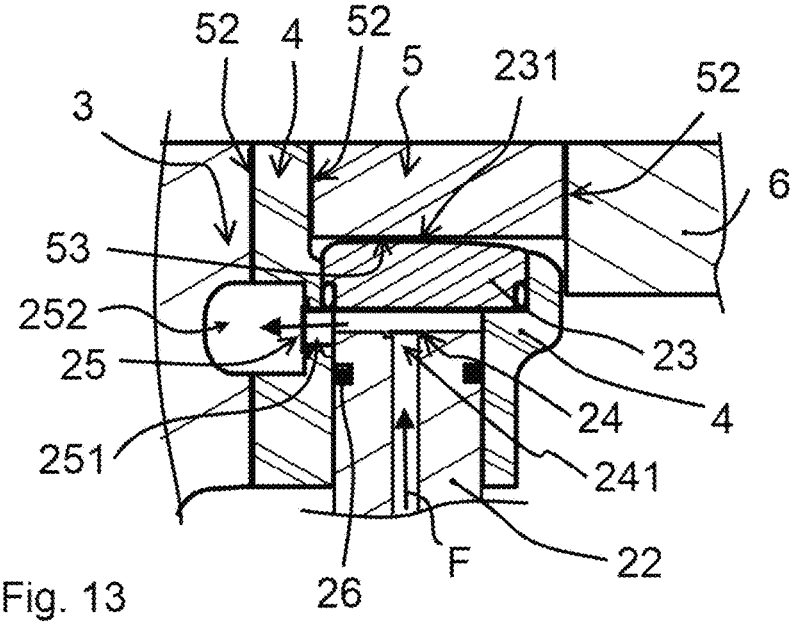
FIG. 13 shows a schematic of the fluid flow of a radial piston pump according to the disclosure.

The fluid F to be compressed flows via the fluid inlet 241 or the inlet valve 24 into the working chamber 21, is compressed there by the stroke movement of the piston 22 and leaves the working chamber 21 through the outlet valve 25 or the fluid outlet 251. Here, for example, reference can be made to FIGS. 11 and 12 for the schematic indication of the flow path. The configuration of the valves, for example as a spring plate valve, is sufficiently known to a person skilled in the art and requires no further explanation here.

According to the invention, it is provided that the radial piston pump is equipped with a retaining ring 51 integrated in a housing component 5 for all of the covers 23, 23*a*, . . . of the piston/working chamber combinations 2, 2*a*, 2*b*, . . . .

To illustrate the difference over a separate retaining ring, reference should be made to FIGS. 1 and 3, which show a separate retaining ring for all of the covers of the piston/working chamber combinations. By comparing the above-mentioned illustrations, FIGS. 1 and 3, on the one hand, and FIGS. 2 and 4, on the other hand, the effect on the external diameter of the overall assembly is shown. It becomes clear that, in the case of the refinement according to the invention with a housing-integrated retaining ring, see in particular FIGS. 2 and 4, the external diameter Da_Geh2 is smaller than in the variant with a separate retaining ring and its external diameter Da_Geh1, see in particular FIGS. 1 and 3.

There are also advantages with regard to the internal diameter of the radial piston pump according to the invention. Accordingly, FIGS. 3 and 4 show the internal diameters of the housings of both variants, on which a low pressure p_ND (see in particular FIG. 5) acts. It can be seen that, in addition to the external housing diameter, the internal housing diameter of the "housing-integrated retaining ring" variant Di_Geh 2 is smaller than the diameter Di_Geh 1 of the "separate retaining ring" variant.

The larger internal diameter of the "separate retaining ring" variant in turn causes the axial force to be greater (with the same pressure). A higher axial force means a greater load on the housing screw connection, in particular a higher operating force for the screws. As a measure for maintaining the sealing effect, in particular axially between the housing parts, the preloading force of the screws would have to be increased, a screw material with higher strength would have to be used and/or the number of screws would have to be increased. All of these measures would lead to an increase in costs. Here, the solution according to the invention of the housing component with an integrated retaining ring affords advantages, since here smaller internal surfaces should be expected or be possible and correspondingly lower forces should be expected.

In particular, FIG. 5 shows the housing components of the radial piston pump. It is preferably provided that the radial piston pump has at least one further housing component, wherein the housing component 5 with an integrated retaining ring 51 and the further housing component or components form the housing of the radial piston pump. The radial piston pump shown here by way of example preferably consists on the housing side of a total of four housing components, which are in particular axially screwed together. A radial piston pump according to the invention comprises, for example, a high-pressure housing 3, the cylinder housing 4, in particular for receiving the piston/working chamber combinations (2, 2*a*, 2*b*, . . . ), the housing component 5 with an integrated retaining ring 51 and a stator housing 6, in particular for receiving a rotor (not shown) of an electric motor. The axial screw connection, preferably a screw connection in the axial direction, which connects all of the housing parts to one another, is preferably designed to ensure the sealing effect with respect to the environment between the housing components, see in particular FIG. 5 in this regard.

Preferably, the housing component 5 with an integrated retaining ring has plane-parallel axial sealing faces 52 in order to be able to ensure the tightness requirements with respect to the adjacent housing parts. Preferably, the surfaces of the sealing faces 52, at least in the region D, are equipped with concentric grooves 521, in particular with a ripple in the radial direction. Preferably, the grooves 521 are configured in the micrometer range, in particular in the sealing region to the outside. Here, in particular, reference can be made to FIG. 10.

In a further advantageous refinement of the invention, it can be provided that the housing components 3, 4, 5, 6 for forming the pump housing are screwed together. Preferably, the housing components are jointly screwed together by means of a screw 27. For this purpose, it can be provided that the cylinder housing 4 has a flange 28 or the like, which serves for the screw connection to the further housing components. The cylinder housing may also have a sealing face 52.

Preferably, fluid channels of the radial piston pump, or at least partial regions of fluid channels, can be formed by means of the housing parts which are screwed together. Such an assembled channel is, for example, the high-pressure channel 252.

The housing components 3 to 6 can delimit or seal various pressure regions within the radial piston pump or toward the outside. In a further advantageous refinement of the invention, it can be provided that the housing component has plane-parallel axial sealing faces. By means of sealing faces configured in such a way, a tight connection to the adjacent housing component, such as to the high-pressure housing 7 or to the stator housing 8, can be provided.

Furthermore, it can be provided that seals are arranged in addition to or solely between the sealing faces 52.

In a further advantageous refinement of the invention, it can be provided that the surfaces of the sealing faces 52 have one or more geometric shapes that deviate from a flat or approximately flat face. Thus, it can be provided that, for the targeted formation of contact faces or linear contacts, at least one of the sealing faces 52 has a concave or convex shape. Thus, for example, a flat sealing face 52 of a housing component can be brought into contact with the convex surface or sealing face 52 of another housing component and therefore provide a seal. By means of contact between a flat and a convex surface, a defined linear contact between the two surfaces is advantageously formed. Such a linear contact can preferably entirely or at least partially represent the function of a seal between corresponding components. Advantageously, one of the surfaces can have elastic behavior, and therefore fluctuations in the distance between the components can be compensated by the elasticity.

Preferably, contact faces 53 are provided on the housing component 5 with an integrated retaining ring 51 and contact faces 231 on the cover 23, the contact faces preferably being designed in such a way that the housing component 5 with an integrated retaining ring 51 can fix the cover 23 on the cylinder housing 4, in particular axially and/or radially, thus accordingly against pressure from the working chamber 21.

Further preferably, the cover 23 and the housing component 5 with an integrated retaining ring 51 have an overlap in the joint diameter, in particular in the region of the cover 23 on the cylinder housing 4, such that an interference fit is produced between the cover 23 and the housing-integrated retaining ring 51.

Figure 14:
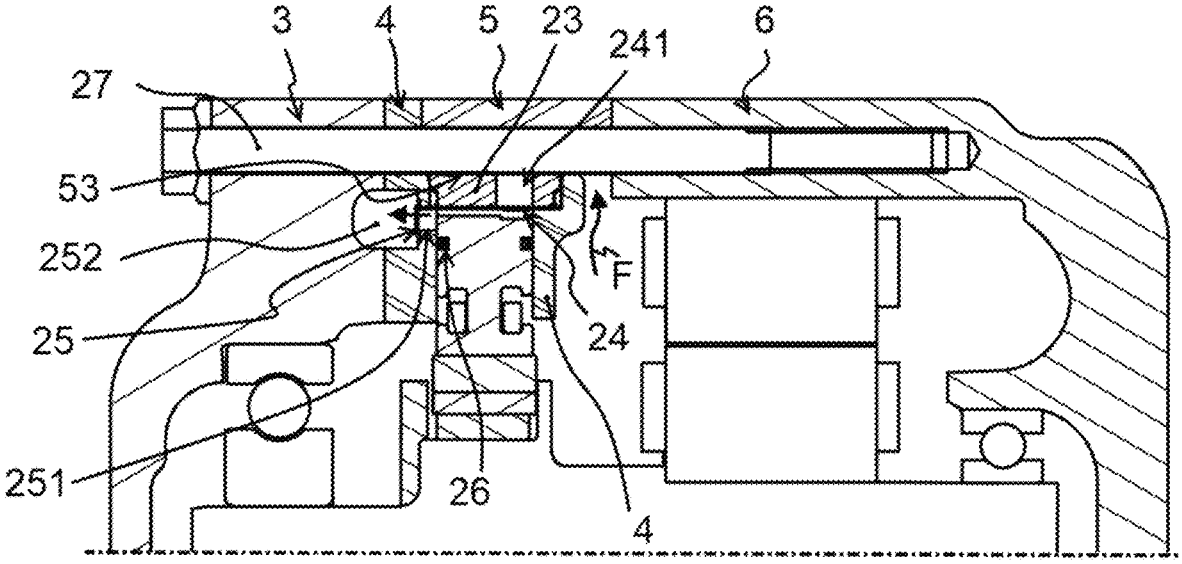
FIG. 14 shows a radial piston pump according to the disclosure in a sectional view.

Preferably, a screw is provided for the connection of all of the housing parts; in other words, the housing parts are connected with a single screw, as shown in FIG. 14 as a detail of a longitudinal section of a radial piston pump according to the invention. When all of the housing components are screwed together by means of one screw, rapid assembly is possible since intermediate screw fittings are omitted.

It can be advantageous, for example, for the cylinder housing 4 and the housing-integrated retaining ring 5 to form a pre-assembled assembly or a module for assembly. The housing part 5 with the housing-integrated retaining ring 51 fixes all of the covers 23 directly on the cylinder housing 4. The housing parts or the pre-assembled modules can be aligned with one another and then screwed together with at least one screw 27. A further advantage which results from the use of the housing component 5 as a separate component is the ability to pre-assemble (without screws) an assembly comprising the housing component 5 and the cylinder housing 4 (preferably with the cover 23 and the valves 24, 25, piston and optionally seals). This assembly can then be easily screwed to the other housing components and the radial piston pump can be fully assembled. Another advantage is the resulting modularity. The housing components or the housing of the radial piston pump can be produced, for example, by injection molding or diecasting. If a radial piston pump with a different cylinder layout is wanted, e.g. a different cylinder volume or a different arrangement/number of cylinders, the installation space required in the axial direction of the radial piston pump usually also changes. By means of the individually adapted housing component 5, it is possible, for example, to react to a changing axial installation space requirement of a cylinder housing 4 modified in such a way. As long as the contact faces or sealing faces are unchanged, the other housing components can be used without modification. Thus, by means of the housing component 5 with an integrated retaining ring 51, a radial piston pump which is modular and/or scalable in its axial construction length (or performance capability) can be formed. The housing component 5 can also be understood as meaning a housing ring or spacer. Details in this respect are shown in particular in FIG. 14.

Preferably, the housing component 5 with an integrated retaining ring 51 should be joined to the cylinder housing 4 with respect to the angular position in an angle-oriented manner so that the passages for the housing screw connection(s) are aligned with one another and the screws can be inserted through or the contact faces 231 or 53 of the cover 23 correspond to the retaining ring 51. For this purpose, it can be provided, for example, that the housing component 5 is 25 equipped with an integrated retaining ring 51 and at least one positioning means, in particular positioning bore. The cylinder housing 4 accordingly has a corresponding positioning means, for example in the form of a pin. The positioning means 54 of the housing component 5 is used in particular for the angular orientation of the integrated retaining ring 51 with respect to the joining device. The cylinder housing should be fixed in the mounting nest in an angle-oriented manner, for example on the clamping slugs or a differently configured geometry. The automated assembly can then join the two housing parts in the correct angular position. The angular orientation is recommended because of the assignment of the contact faces between the cover 23 and integrated retaining ring 51.

By this means, it can be ensured, for example, that, during the assembly, the housing component 5 with an integrated retaining ring 51 can be joined in the correct angular position, for example, for picking up in the gripper of the tool. It can also be advantageously provided that the housing component 5 with an integrated retaining ring 51 is equipped with a second positioning means, in particular second positioning bore 54. A second positioning bore, in particular with an angular offset not equal to 180° with respect to the first positioning bore, is particularly advantageous if, for example, a chamfer or rounding is present on the inner ring edge on one side of the retaining ring 51, which facilitates the joining of the retaining ring 51.

The second positioning bore arranged offset ensures that the housing component 5 with an integrated retaining ring 51 is always installed at the correct angle.

The second positioning bore can be on a different hole circle from the first bore, with the advantage of secure angular alignment, and with the advantage that the housing component 5 then also cannot be installed the wrong way round (rotated 180° about the vertical axis) if a chamfer is provided on one side of it for the joining.

In a further configuration, 3 bores are provided, with one being arranged on a different radius or hole circle. The advantage is, as mentioned above, the clearly angle-oriented and correct side assignment for the housing component.

It can also be preferably provided that the cover 23 has the inlet valve or valves 24.

Preferably, the housing component 5 with an integrated retaining ring 51 should be made of steel or a steel alloy at least in sections, but at least the retaining ring 51 as such, so that it advantageously meets the high strength requirements of its function as a retaining ring (surface pressure with respect to the cover).

The material and/or production method of the housing component 5 with an integrated retaining ring 51 includes all of the materials or production methods known from the prior art, such as casting, turning or milling (coarse and fine).

It may also be preferably provided that the contact face of the cover and/or the associated contact face of the housing component with an integrated retaining ring is flat or concave/convex, wherein the curvature of the cover or the housing component with an integrated retaining ring can run axially with respect to the shaft of the compressor and/or transversely with respect thereto.

It can also be preferably provided that surface contact is provided between the cover and the housing component with an integrated retaining ring.

It can also be preferably provided that compensation of tolerances is provided between the cover and the housing component with an integrated retaining ring.

It can also be preferably provided that the housing component with an integrated retaining ring and the cover at least partially have mutually corresponding shapes.

Figure 8:
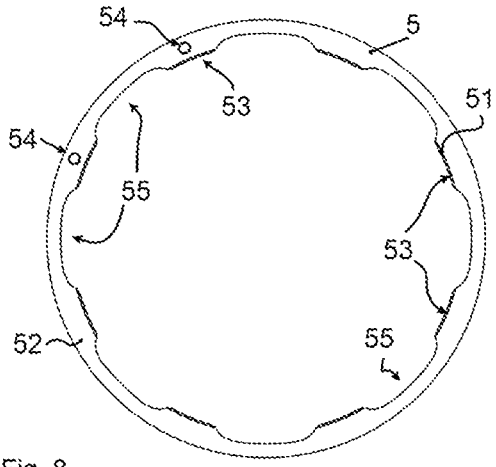
FIG. 8 shows a housing component of a radial piston pump according to the disclosure.
Figure 9:
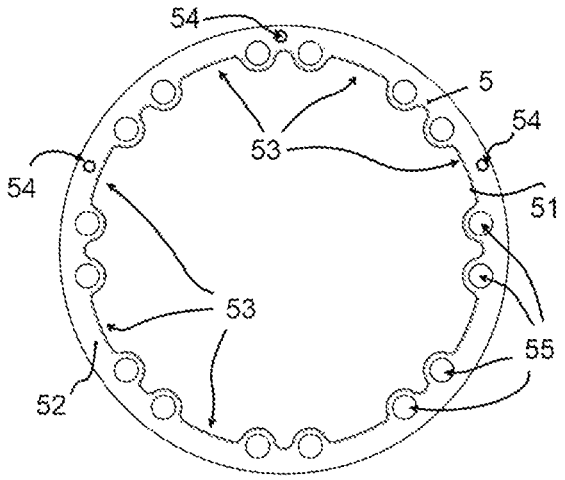
FIG. 9 shows a housing component of a radial piston pump according to the disclosure.

Possible configurations of the housing component with an integrated retaining ring, in particular the passages thereof for the housing screw connection, are illustrated in particular in FIGS. 7 to 9.

FIG. 7 shows, for example, a variant in which the passage 55 for the housing screw connection is interrupted inwardly. The position of the passages is arranged within the ring next to the region of the cover system. The housing component 5 with an integrated retaining ring 55 preferably has two plane-parallel axial contact faces, which constitute the sealing face with respect to the adjacent housing parts. The arrows show by way of example the contact points for contact on the cover. Eight contact points are provided here, so that the housing component, shown here, with an integrated retaining ring can accordingly be used to fix eight covers. The variant outlined here is distinguished in particular by requiring less installation space, in particular because of a lack of enclosing of the screw passages/bores.

FIG. 8 shows a housing component with an integrated retaining ring with a stress-optimized interruption for the passages for the screw connection. For illustrative purposes, arrows here show by way of example possible contact points for contact on the cover. The variant outlined here is distinguished in particular by requiring less installation space, in particular because of a lack of enclosing of the passages.

FIG. 9 shows a housing component 5 with an integrated retaining ring 51 with fully enclosed passages for the screw connection. For illustrative purposes, arrows here show by way of example possible contact points for contact on the cover 23. The variant outlined here is distinguished in particular by the fact that no pressure spreads between the screw and the screw bore. This means that the screw bore is therefore already sealed by the refrigerant inside the compressor. An additional seal, e.g. under the screw head, is not in principle required.

In particular, FIG. 14 shows the simultaneous screw connection of all of the housing components 3-6. FIG. 14 is a part of a longitudinal section through the radial piston pump; the section is laid out separately (profile indicated in FIG. 6) such that the screw connection/screw is shown. This does not show the cover 23 and the required inlet valve. It is clear that the screw must not cover the inlet opening. As can be seen from the figures, the screw connection is preferably provided next to the contact faces between housing component 5 and cover 23 in order to reduce the radial installation space. In principle, it is conceivable that the geometries of the integrated retaining ring are formed in the stator housing and that the stator housing has integrated the function of the housing component 5. The housing component 5 can be considered to be a type of housing washer. The contact faces can be machined over the entire length of the housing washer. If the functions of housing component 5 and thus the contact faces 53 with respect to the cover 23 are formed on the stator housing 6, the machining is more complex and therefore expensive.

What is claimed is:

1. A radial piston pump, comprising:

a drive shaft having at least one piston/working chamber combination, wherein the at least one piston/working chamber combination includes a working chamber and a piston;

at least two piston/working chamber combinations extending radially from the drive shaft, wherein each working chamber is closed with a cover; and a housing component with an integrated retaining ring for fixing all of the covers of the radial piston pump;

wherein contact faces are provided on the housing component with the integrated retaining ring and on the covers, wherein the contact faces are configured to allow the housing component with the integrated retaining ring to fix the covers;

wherein the contact faces with respect to and/or of the respective covers are concave/convex;

wherein curvatures of the covers or of the housing component with the integrated retaining ring are axially aligned with respect to the drive shaft of the radial piston pump and/or transversely aligned with respect thereto;

wherein the housing component with the integrated retaining ring consists of steel or a steel alloy at least in sections;

wherein the housing component with the integrated retaining ring includes a main body and locking protrusions that extend radially inward from the main body, wherein the locking protrusions are configured to fix the covers.

2. The radial piston pump of claim 1, wherein the radial piston pump includes at least three piston/working chamber combinations which are arranged in a star shape around the drive shaft.

3. The radial piston pump of claim 1, wherein the radial piston pump has at least one further housing component including a cylinder housing and/or a stator housing, wherein the housing component with the integrated retaining ring and the at least one further housing component form a housing of the radial piston pump.

4. The radial piston pump of claim 1, wherein the housing component with the integrated retaining ring has plane-parallel axial sealing faces.

5. The radial piston pump of claim 1, wherein the contact faces of the housing component with the integrated retaining ring are provided with concentric grooves, with a ripple in a radial direction.

6. The radial piston pump of claim 1, wherein the covers and the housing component with the integrated retaining ring have respective diameters, such that an interference fit is produced between the covers and the housing component with the integrated retaining ring.

7. The radial piston pump of claim 3, wherein at least one screw is provided for the connection of the housing component with the integrated retaining ring and the at least one further housing component.

8. The radial piston pump of claim 1, wherein surface contact is provided between the covers and the housing component with the integrated retaining ring.

9. The radial piston pump of claim 1, wherein the housing component with the integrated retaining ring and the covers at least partially have mutually corresponding shapes.

10. The radial piston pump of claim 1, wherein the housing component with the integrated retaining ring has at least one passage for a housing screw connection, wherein the at least one passage for the housing screw connection is interrupted inwardly or is a fully enclosed passage for the screw connection.

11. The radial piston pump of claim 1, wherein at least one positioning means is provided in the housing component with the integrated retaining ring.

12. A radial piston pump, comprising:

a drive shaft having at least one piston/working chamber combination, wherein the at least one piston/working chamber combination includes a working chamber and a piston;

at least two piston/working chamber combinations extending radially from the drive shaft, wherein each working chamber is closed with a cover; and a housing component with an integrated retaining ring for fixing all of the covers of the radial piston pump;

wherein contact faces are provided on the housing component with the integrated retaining ring and on the covers, wherein the contact faces are configured to allow the housing component with the integrated retaining ring to fix the covers;

wherein the contact faces with respect to and/or of the respective covers are concave/convex;

wherein curvatures of the covers or of the housing component with the integrated retaining ring are axially aligned with respect to the drive shaft of the radial piston pump and/or transversely aligned with respect thereto;

wherein the housing component with the integrated retaining ring consists of steel or a steel alloy at least in sections;

wherein the housing component with the integrated retaining ring has at least one passage for a housing screw connection, wherein the at least one passage for the housing screw connection is interrupted inwardly or is a fully enclosed passage for the screw connection.

13. The radial piston pump of claim 12, wherein the contact faces of the housing component with the integrated retaining ring are provided with concentric grooves, with a ripple in a radial direction.

14. The radial piston pump of claim 13, wherein the housing component with the integrated retaining ring includes a main body and locking protrusions that extend radially inward from the main body, wherein the locking protrusions are configured to fix the covers.

15. The radial piston pump of claim 12, wherein the covers and the housing component with the integrated retaining ring have respective diameters, such that an interference fit is produced between the covers and the housing component with the integrated retaining ring.

16. The radial piston pump of claim 12, wherein:

the radial piston pump has at least one further housing component including a cylinder housing and/or a stator housing, wherein the housing component with the integrated retaining ring and the at least one further housing component form a housing of the radial piston pump; and at least one screw is provided for the connection of the housing component with the integrated retaining ring and the at least one further housing component.

17. A radial piston pump, comprising:

a drive shaft having at least one piston/working chamber combination, wherein the at least one piston/working chamber combination includes a working chamber and a piston;

at least two piston/working chamber combinations extending radially from the drive shaft, wherein each working chamber is closed with a cover; and a housing component with an integrated retaining ring for fixing all of the covers of the radial piston pump;

wherein contact faces are provided on the housing component with the integrated retaining ring and on the covers, wherein the contact faces are configured to allow the housing component with the integrated retaining ring to fix the covers;

wherein the contact faces with respect to and/or of the respective covers are concave/convex;

wherein curvatures of the covers or of the housing component with the integrated retaining ring are axially aligned with respect to the drive shaft of the radial piston pump and/or transversely aligned with respect thereto;

wherein the housing component with the integrated retaining ring consists of steel or a steel alloy at least in sections;

wherein the contact faces of the housing component with the integrated retaining ring are provided with concentric grooves, with a ripple in a radial direction.

18. The radial piston pump of claim 17, wherein the covers and the housing component with the integrated retaining ring have respective diameters, such that an interference fit is produced between the covers and the housing component with the integrated retaining ring.

19. The radial piston pump of claim 17, wherein:

the radial piston pump has at least one further housing component including a cylinder housing and/or a stator housing, wherein the housing component with the integrated retaining ring and the at least one further housing component form a housing of the radial piston pump; and at least one screw is provided for the connection of the housing component with the integrated retaining ring and the at least one further housing component.

* * * * *